US008399086B2

(12) United States Patent
Itoh et al.

(10) Patent No.: US 8,399,086 B2
(45) Date of Patent: Mar. 19, 2013

(54) HOOKING MEMBER FOR IN-MOLD MOLDING

(75) Inventors: Hiroshi Itoh, Nara (JP); Satoru Ono, Fukui (JP)

(73) Assignee: Kuraray Fastening Co., Ltd., Osaka-shi (JP)

( * ) Notice: Subject to any disclaimer, the term of this patent is extended or adjusted under 35 U.S.C. 154(b) by 232 days.

(21) Appl. No.: 12/988,886

(22) PCT Filed: Apr. 15, 2009

(86) PCT No.: PCT/JP2009/057582

§ 371 (c)(1),
(2), (4) Date: Oct. 21, 2010

(87) PCT Pub. No.: WO2009/131044

PCT Pub. Date: Oct. 29, 2009

(65) Prior Publication Data

US 2011/0030176 A1 Feb. 10, 2011

(30) Foreign Application Priority Data

Apr. 23, 2008 (JP) ..... 2008-112620

(51) Int. Cl.
*A44B 18/00* (2006.01)
*B32B 3/06* (2006.01)

(52) U.S. Cl. ..... 428/99; 428/100; 428/136; 24/452

(58) Field of Classification Search ..... 428/99, 428/100, 136; 24/442, 452
See application file for complete search history.

(56) References Cited

U.S. PATENT DOCUMENTS 3,717,908 A * 2/1973 Perina ..... 24/444
5,170,744 A 12/1992 Pruitt et al.
5,540,970 A 7/1996 Banfield et al.
5,688,576 A 11/1997 Ohno et al.
5,786,061 A 7/1998 Banfield
5,922,436 A * 7/1999 Banfield et al. ..... 428/100
6,460,230 B2 10/2002 Shimamura et al.
7,648,751 B2 * 1/2010 Janzen et al. ..... 428/99
2002/0023322 A1 2/2002 Murasaki

FOREIGN PATENT DOCUMENTS

JP 6-501187 2/1994
JP 7-148007 6/1995
JP 9-506559 6/1997
JP 2000-516485 12/2000
JP 2002-78512 3/2002

OTHER PUBLICATIONS

International Search Report issued Jul. 21, 2009 in International Application No. PCT/JP2009/057582 (With Translation of Category of Cited Documents).

* cited by examiner

*Primary Examiner* — Alexander Thomas
(74) *Attorney, Agent, or Firm* — Oblon, Spivak, McClelland, Maier & Neustadt, L.L.P.

(57) ABSTRACT

A mold-in fastening member which is composed of a strip of substrate, engaging elements formed on one surface of the substrate, and an elastomer layer completely surrounding the engaging elements, the substrate having slits or notches which extend from a widthwise central portion of the substrate to a widthwise end portion of the substrate. The mold-in fastening member bends in conformity with a two- or three-dimensionally complicated shape of a molded article. The mold-in fastening member prevents the surface having the engaging elements from being covered with a foamable liquid molding resin during a mold-in process, thereby preventing the engaging elements from losing the engaging function.

9 Claims, 2 Drawing Sheets

HOOKING MEMBER FOR IN-MOLD MOLDING

TECHNICAL FIELD

The present invention relates to a mold-in fastening member which is attached to the surface of a molded article of foamed resin for use as a cushion for automotive seats and office chairs at the tune of its molding, and further relates to a production method of a molded article of foamed resin having the fastening member attached on its surface.

The molded article of foamed resin having the fastening member is made into a seat by covering its surface with an upholstery material such as cloth and then joining the engaging elements of the fastening member with the cooperating engaging elements on the back surface of the upholstery material thereby fixing the upholstery material to the molded article of foamed resin.

BACKGROUND ART

The seat of automotive seats and office chairs is composed of a cushion made of a foamed urethane, etc. and a seat cover (upholstery material) covering the surface of cushion.

In the production of automotive seats, a so-called mold-in process is used, wherein a fastening member having a number of engaging elements on its top surface and a number of anchoring elements on its back surface is placed in the desired position of a mold; and a molding resin (foamable liquid resin) is injected into the mold and allowed to foam so that the anchoring elements are embedded in the resulting molded article of foamed resin, thereby uniting the molded article of foamed resin and the fastening member while allowing the fastening member to be embedded in the surface of the molded article of foamed resin such that the engaging elements are exposed on the outer surface of the molded article of foamed resin.

The seat cover (upholstery material) has on its back surface the engaging elements which cooperate with the engaging elements of the fastening member. By joining the cooperating engaging elements with the engaging elements on the surface of the molded article of foamed resin, the seat cover is fixed to the molded article of foamed resin along its surface.

Formerly, a hard fastening member having hook engaging elements (hereinafter may be referred to as "hook member") has been used as the fastening member to be placed in the mold because of its easiness of handling. In the method of using the hook member, the back surface thereof is embedded in a resin molded article so as to expose the hook engaging elements on the surface thereof, and the exposed hook engaging elements are joined with the loop engaging elements foamed on an upholstery material (for example, Patent Document 1).

In the mold-in process mentioned above, generally, the fastening member is placed into a narrow recess which is formed at a given position of a mold while allowing its surface having hook engaging elements to face the bottom of the recess and then a foamable liquid molding resin is injected into the mold while keeping the fastening member in position to perform the molding. In conducting the mold-in process with the fastening member fitted to the recess, the introduced liquid resin enters into the side of engaging elements through gaps between the fastening member and the recess, thereby encasing the engaging elements in the foamed resin. Since the engaging elements surrounded by the resin no longer have the engaging function, the liquid resin should be prevented from entering into the mold in the mold-in process so as to prevent the surface having engaging elements from being encased in the resin.

Recently, the structure and design of seat come to be complicated and widely range, and therefore, the molded article of foamed resin for seats is needed to change its shape from a flat plate shape to a two-dimensional shape and further to a three-dimensionally curved shape. However, in the technique of incorporating the known hard hook member into the molded article of foamed resin, it is very difficult to bend the hook member three-dimensionally (bend the hook member roundly) and to produce a molded article while preventing the surface having engaging elements from being surrounded by the resin. For example, a known hard hook member is hardly bent sideways in nearly parallel to the hook surface, i.e., hardly bent in plane because of its poor elasticity. Therefore, it is quite difficult to fit the fastening member into the recess in a mold by bending it roundly so as to follow the three-dimensionally curved recess. If the fastening member is forcedly bent, it bends with kink. Alternatively, the inner side and the outer side at the bend portion do not lie on the same plane, and therefore, the outer side or the inner side rises from the recess and a foamable liquid molding resin flows into the recess from the rising portion to make the surface having engaging elements encased in the foamed molding resin.

As described above, it is very difficult to bend a known fastening member roundly so as to conform to the three-dimensionally curved surface. If it is forcedly bent, gaps which allow the foamable liquid molding resin to enter into the recess are left between the hard fastening member and the recess formed in the mold. As a result, the hook surface of the fastening member is covered by the foamed molding resin and the hook elements lose the engaging function because the foamed molding resin covering the fastening member is difficult to remove.

To avoid the problem caused by bending the hook member three-dimensionally, Patent Document 2 proposes to reduce the apparent rigidity of the hook fastening member to make the in-plane deformation easy by providing at least one ridge for controlling deformation on the back side of substrate (surface opposite to hook engaging elements). The proposed method is somewhat effective when the fastening member is slightly deformed in plane or the substrate of fastening member has a narrow width. However, the problem of the surface of engaging elements to be covered by the foamed molding resin is not solved so greatly and the proposed method is not so effective if the in-plane deformation is large and the width of substrate is large.

Patent Document 1: JP 5-016173A

Patent Document 2: JP 2006-122269A

DISCLOSURE OF INVENTION

Problems to be Solved by Invention

To solve the above problems, an object of the present invention is to provide a mold-in fastening member which can be bent so as to conform to the two- or three-dimensionally complicated shape of a molded article, which closely fits a recess formed in a mold thereby to prevent a foamable liquid molding resin from entering into the recess thereby preventing the surface having engaging elements from being covered with the foamable liquid molding resin and the engaging elements from losing the engaging function, and which is suitable for the mold-in production of a molded article of foamed resin having a two- or three-dimensionally complicated structure.

Means for Solving the Problems

As a result of research for solving the above problems, the inventors have found that the above problems are solved by a mold-in fastening member having its surface of engaging elements coated with a removable elastomer layer and provided with slits or notches extending in its width direction.

Thus, the present invention relates to a mold-in fastening member which comprises a strip of substrate, engaging elements formed on one surface of the substrate, and an elastomer layer completely surrounding the engaging elements, the substrate having slits or notches which extend from a widthwise central portion of the substrate to a widthwise end portion of the substrate.

It has been further found that the mold-in fastening member is more effective when the widthwise length of the slits or notches is ¼ to ¾ of the width of the fastening member, when the slits or notches are formed at intervals of 5 to 30 mm in the lengthwise direction of the fastening member, and when the elastomer layer contains magnetically attractable powder.

It has been further found that the mold-in fastening member is suitable in any of cases when neither of the widthwise end portions of the surface having the engaging elements is covered with the elastomer layer, when an anchoring member or anchoring elements are formed on the surface opposite to the surface having the engaging elements, when the elastomer layer and the substrate have different colors, and when the elastomer layer has no slit or notch.

The present invention further relates to a production method of a molded article of foamed resin having the fastening member, which utilizes the mold-in fastening member which comprises a strip of substrate, engaging elements formed on one surface of the substrate, and an elastomer layer covering the engaging elements, the substrate having slits or notches which extend from a widthwise central portion of the substrate to a widthwise end portion of the substrate. The method comprises fitting the mold-in fastening member into a recess formed inside a mold while allowing the elastomer layer to face a bottom of the mold; injecting a foamable liquid resin into the mold; hardening the foamable resin to obtain a molded article having the fastening member; releasing the molded article having the fastening member from the mold; and removing the elastomer layer.

Effect of Invention

According to the present invention, a mold-in fastening member which follows a two- or three-dimensionally complicated shape of molded article is provided. The mold-in fastening member can be fixed to a desired position on the surface of a molded article of foamed resin having a complicated curved surface, such as those for seats of high-class motor cars. Since the engaging elements on the surface of the fastening member are exposed without being surrounded by a foamed resin, the engaging elements join with the cooperating engaging elements on the back side of a seat cover (upholstery material) to make the seat cover fixed to the molded article. Thus, the seat cover covers the surface of the resin molded article to give an automotive seat with a high-quality appearance.

In the present invention, the elastomer layer covering the engaging elements prevents the engaging elements from being covered with the foamed resin which is injected into a mold. The elastomer layer also allows the fastening member to smoothly bend in conformity with the two or three-dimensionally complicated shape of curved surface, i.e., the elastomer layer makes the fastening member easy to bend laterally in plane with the inner side and the outer side of the bend portion lying on the same plane. The slits or notches which extend in the widthwise direction of the fastening member also make the fastening member easy to bend laterally in plane with the inner side and the outer side lying on the same plane.

As mentioned above, in the present invention the combination of the elastomer layer covering the engaging elements and the slits or notches extending the widthwise direction of the fastening member allows the deformation in conformity with the two- or three-dimensionally complicated curved surface.

REFERENCE NUMERALS

Figure 1:
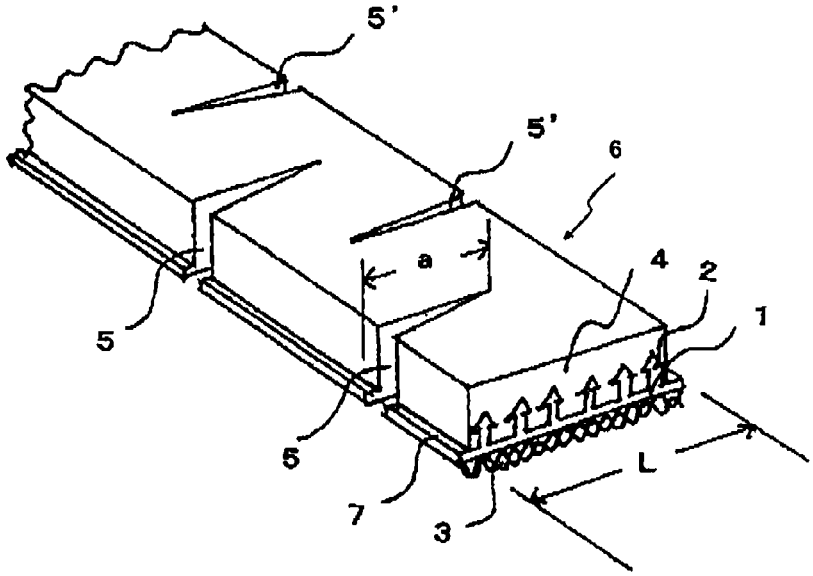
FIG. 1 is a perspective view of one embodiment of the mold-in fastening member of the invention.

1: substrate
2: engaging elements
3: anchoring member or anchoring elements
4: elastomer layer
5 and 5': slits or notches
6: mold-in fastening member
7: widthwise end portions of fastening member
8: mold
9: mold recess
10: magnet
M: main structure of mold-in fastening member

BEST MODE FOR CARRYING OUT THE INVENTION

Figure 2:
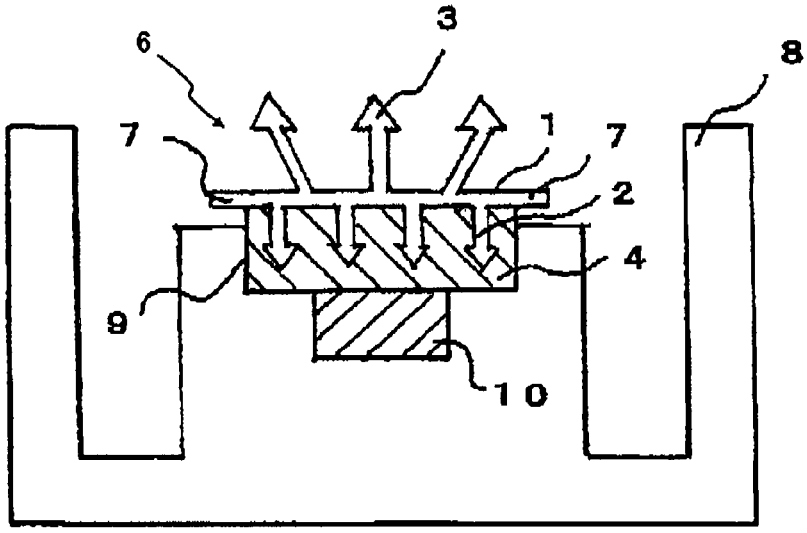
FIG. 2 is a schematic cross-sectional view showing a mold and the mold-in fastening member of the invention fitted into a recess of the mold.

The present invention will be described with reference to the drawings. FIG. 1 is a perspective view of one embodiment of the mold-in fastening member of the invention. FIG. 2 is a cross-sectional view showing a mold and the mold-in fastening member fitted into a recess in the mold. In FIGS. 1 and 2, parts are indicated by respective reference numerals: a substrate by 1, engaging elements by 2, an anchoring member or anchoring elements by 3, an elastomer layer by 4, slits or notches by 5 and 5', widthwise end portions of fastening member by 7, a mold by 8, a mold recess by 9, and a magnet by 10.

As seen from FIGS. 1 and 2, the substrate 1 has the engaging elements 2 on its upper surface and the anchoring member 3 (FIG. 1) or the anchoring elements 3 (FIG. 2) on its back surface. The engaging elements 2 on the upper surface of the substrate are completely surrounded by the elastomer layer 4. The substrate 1 has the slits or notches 5, 5' each of which extends from its widthwise central portion to its widthwise end portion.

As described above, the mold-in fastening member of the invention is mainly composed of a strip of substrate 1 having the engaging elements 2 on its one surface and the elastomer layer 4 covering the engaging elements.

In view of the productivity and the peeling resistance of the engaging elements and anchoring elements, the substrate 1, the engaging elements on its upper surface, and the optional anchoring elements on its back surface are preferably formed from the same resin.

The width of the substrate 1 is preferably 5 to 20 mm, more preferably 6 to 15 mm, and still more preferably 7 to 12 mm. If being excessively large, the substrate is difficult to bend into a three-dimensionally complicated shape. If been excessively small, the number of the engaging elements formed on the substrate is reduce to result in a poor engaging force. The thickness of the substrate 1 is preferably 0.1 to 1 mm and more preferably 0.3 to 0.7 mm. If being excessively thin, the strength of the substrate is poor. If being excessively thick, the substrate is difficult to bend into a three-dimensionally complicated shape.

The shape of the engaging elements 2 may be either of arrowhead, mushroom or hook. The height of the engaging elements above the surface of the substrate is preferably 1 to 5 mm and more preferably 1.5 to 3 mm, although not particularly limited thereto. The density of the engaging elements is preferably 10 to 120/cm$^2$ and more preferably 20 to 80/cm$^2$. The engaging elements generally project from the substrate nearly vertical to its surface and are arrayed in columns along the lengthwise direction of the substrate. The number of the engaging elements in one column is preferably 3 to 20/cm. In view of the engaging force, the number of such columns in the widthwise direction of the substrate is preferably 2 to 20/cm and particularly preferably 3 to 8/cm.

In view of firmly uniting the fastening member and the foamed molded article, the substrate preferably has the anchoring member or anchoring elements 3 on its back surface. It is preferred that two or more anchoring elements 3 project from the back surface of the substrate 1 nearly vertically or slantly. Since cloth has the anchoring effect, the anchoring member may be formed by attaching cloth such as woven fabric, knitted fabric and nonwoven fabric to the back surface of the substrate. The anchoring member and anchoring elements are embedded in the molded article of foamed resin to prevent the fastening member from being separated from the molded article of foamed resin.

The anchoring member and anchoring elements 3 may be continuous in the lengthwise direction of the fastening member or may be, like the engaging elements 2, discontinuous in the lengthwise direction of the fastening member.

Synthetic resins which are thermoplastic and difficult to be elastically deformed at around room temperature, i.e., non-elastic resins are used as the material for the substrate 1, engaging elements 2 and anchoring elements 3.

Examples of such resins include a polyolefin-based thermoplastic resin such as polyethylene and polypropylene; a polyester-based thermoplastic resin such as polyethylene terephthalate, polybutylene terephthalate and polylactic acid; and a polyamide-based thermoplastic resin such as nylon 6 and nylon 66, with the polyolefin thermoplastic resin being preferred and the polypropylene being particularly preferred.

These thermoplastic resins are preferably blended with an elastic thermoplastic resin because the rigidity is reduced, the flexibility is enhanced, the fitting of the fastening member into the mold recess is easy, and the fastening member bends three-dimensionally easily. The elastic thermoplastic resin is a synthetic polymer which has elasticity and flexibility resembling rubber at around room temperature and is softened at high temperatures to allow easy molding. Examples thereof include a styrene-based elastomer, a polyvinyl chloride-based elastomer, an olefin-based elastomer, an urethane-based elastomer, an ester-based elastomer, and an amide-based elastomer. When the substrate is formed mainly by the polyolefin-based resin such as polypropylene, the olefin-based elastomer is suitable in view of the formability and the strength of the resulting fastening member. The olefin-based elastomer may include a polypropylene resin acquiring rubbery elasticity by adding a ethylene-propylene rubber or EPDM.

The thermoplastic elastomer is preferably added in an amount of 2 to 30% by weight of the non-elastic thermoplastic resin which forms the substantial part of the substrate.

When the cloth is used as the anchoring member, cloth having a relatively coarse texture which is made from general natural fibers, synthetic fibers or regenerated fibers is usable. When the cloth having a relatively coarse texture is used, a foamable liquid resin penetrates into the cloth to enhance the peeling strength between the fastening member and the molded article of foamed resin.

The fastening member having the engaging elements on its upper surface and the anchoring elements on its back surface is produced by melt-extruding the thermoplastic resin into tape form from a nozzle having a slit having a shape corresponding to the lengthwise cross section of each of the substrate, the engaging elements and the anchoring elements, thereby forming a tape having ridges of the engaging elements which are continuous in the lengthwise direction of the tape and project from the upper surface and ridges of anchoring elements project from the back surface; slitting down the continuously projecting ridges of the engaging elements at small intervals; and then stretching the tape in the lengthwise direction. The anchoring elements may be continuous in the lengthwise direction of the tape, or may be made discontinuous by slitting down at small intervals in the lengthwise direction as in the case of the engaging elements.

When the cloth such as woven fabric, knitted fabric and nonwoven fabric is used as the anchoring member, the cloth is attached to the back side of the obtained fastening member by an adhesive or heat bonding.

In the present invention, the engaging elements on the upper surface of the substrate of the obtained fastening member are covered with the elastomer layer. The elastomer to be used may include a thermoplastic elastomer and rubber. Examples of the elastomer include a thermoplastic elastomer such as an olefin-based elastomer, a styrene-based elastomer, a polyvinyl chloride-based elastomer, an ester-based elastomer, and an amide-based elastomer; and a rubber-based elastomer such as butadiene rubber, isoprene rubber, styrene-butadiene rubber, butyl rubber, nitrile rubber, ethylene-propylene rubber, silicone rubber, chloroprene rubber, acryl rubber, fluorine rubber, and natural rubber, with the olefin-based elastomer, the styrene-based elastomer (for example, a block copolymer constituted by styrene block-diene block-styrene block in which the diene block is hydrogenated), the ester-based elastomer, butadiene rubber, silicone rubber being preferred. Since the elastomer is generally not adhesive to the non-elastomeric resin which forms the substrate and engaging elements, the elastomer layer is easily separated from the substrate and engaging elements.

It is preferred that the elastomer layer has a thickness which allows the engaging elements to be completely encased in the elastomer layer and is equal to or less than the thickness of the substrate. The thickness is more preferably 2 to 8 mm and still more preferably 3 to 6 mm. The fastening member easily bends roundly in its lateral direction, i.e., the easiness of bending is enhanced with increasing thickness of the elastomer layer. However, the amount of waste resin in turn is increased, because the elastomer layer is finally removed from the foamed molded article such as cushion. Therefore, it is recommended that the thickness of the elastomer layer is determined according to the balance between the easiness of bending and the amount of waste resin. If the elastomer is thermoplastic, the elastomer removed from the molded article of foamed resin can be reused.

The elastomer layer may cover the whole surface of the substrate. As shown in FIG. 1, the elastomer layer may partially cover the widthwise central portion of the substrate without covering both the widthwise end portions 7 of the substrate. It is preferred that neither the widthwise end portions 7 of the substrate are covered with the elastomer layer, because both the widthwise end portions can act as the anchoring elements to make the fastening member difficult to separate from the surface of the molded article of foamed resin. It is also preferred that the engaging elements formed on both the widthwise end portions of the substrate are not covered with the elastomer layer, because the engaging elements also act as the anchoring elements.

The substrate is provided with the slits or notches as described below. The elastomer layer may be also provided with the slits or notches which continuously extend from the substrate or may have no slits or notches. If the elastomer layer is also provided with the slits or notches which continuously extend from the substrate, the foamable liquid resin may enter into the slits or notches of the elastomer layer though the slits or notches of the substrate. The entered foamable resin may remain as the foamed resin on the engaging elements after removing the elastomer layer thereby reducing the engaging force of the engaging elements in some cases.

The elastomer layer is preferably added with the magnetically attractable powder (powder attractable to magnet, for example, ferrite powder), because the fastening member is firmly fixed to the recess in position by a magnet disposed on the bottom of the recess. The amount of the magnetically attractable powder to be added is preferably 30 to 100% by weight and more preferably 40 to 80% by weight based on the elastomer.

The substrate of fastening member and the elastomer layer preferably have different colors, because it can be visually easily confirmed whether or not the elastomer layer is removed completely. For example, the substrate is colored in white by adding a white pigment, and the elastomer layer is colored in black by adding a black pigment or the magnetically attractable powder. Thus, the substrate and the elastomer layer are visually easily distinguished from each other, and it can be instantly judged whether or not the elastomer layer is completely removed from the substrate.

The elastomer layer is formed by supplying a softened elastomer liquid on the engaging elements; pressing the elastomer onto the engaging elements while the elastomer is still flowable so as to closely bond the elastomer to the substrate; and then hardening the elastomer by cooling. This method is preferred because it is easy and simple. When the elastomer layer is formed by this method, the engaging elements should be prevented from being deformed by the heat of the supplied elastomer. Therefore, it is preferred that the softening temperature of the engaging elements is higher than the temperature of the supplied elastomer, for example, the engaging elements is formed by a resin having a softening temperature higher than that of the elastomer by 20° C. or more.

The technique of preventing the engaging elements from being surrounded by a foamed resin by covering the engaging elements of a mold-in fastener with an elastomer such as rubber and then removing the elastomer after mold-in process has been known (for example, JP 9-506559A and JP 6-501187A). However, a fastening member capable of being deformed in conformity with the two or three-dimensionally complicated shape cannot be obtained by merely covering the engaging elements with the elastomer.

In the present invention, therefore, the effect of allowing the fastening member to follows the two- or three-dimensionally complicated shape is achieved by the combination of the elastomer layer covering the engaging elements and the slits or notches provided on the widthwise lateral sides of the fastening member.

The depth of slits or notches (shown by "a" in FIG. 1) is preferably ¼ to ¾ and more preferably ⅓ to ⅔ of the width of the substrate (shown by L in FIG. 1). If less than ¼, the fastening member does not laterally bend sufficiently in some cases. If more that ¾, the fastening member is easily broken at slits or notches to make its handling difficult. The slit is a narrow cut formed by merely cutting by a cutting tool. The notch is a narrow indentation formed by removing a small portion by cutting. The shape of notch may be wedge, triangle, box, fan, semicircle, and trapezoid. In FIG. 1, wedge notches are shown.

It is required in the present invention to form the slits or notches on the substrate, which extend from the widthwise central portion to the widthwise end portion of the substrate. In FIG. 1, the notch 5 extends from the widthwise central portion of the fastening member to one widthwise end portion, and the notch 5' extends from the widthwise central portion of the fastening member to the other widthwise end portion. By forming the notches at both lateral sides, the fastening member easily bends into both the laterally left and right directions. It is particularly preferred that the slits or notches are formed symmetrically with respect to the center line along the longwise direction of the substrate, because the fastening member more easily bends laterally. In this case, the depth of slits or notches (shown by "a" in FIG. 1) is preferably ¼ to ⅖ of the width of the substrate. The slits or notches are formed preferably at intervals of 5 to 30 mm in the lengthwise direction of the fastening member, because the deformability by bending and the strength of the fastening member are good.

The production of the resin molded article having the fastening member of the invention will be described with reference to FIG. 2.

The mold-in fastening member 6 is fitted into the mold recess 9 formed in the mold 8 while allowing the engaging elements 2 covered with the elastomer layer 4 to face the bottom of the recess. If the recess curves three-dimensionally complicatedly, the fastening member of the invention is particularly effective. In the known method, when the recess curves to left and right, the fastening member is cut into short pieces and the short fastening members are fitted into the mold recess so as to follows its curved shape. In contrast, the fastening member 6 of the invention easily bends up and down (to the thickness direction) and also to right and left (to the width direction), therefore, the fastening member can follow the shape of the mold recess curved to right and left without cutting. This enables the quick set of the fastening member into the mold recess to significantly improve the workability.

The magnetically attractable powder, if included in the elastomer layer, is attracted by the magnet 10 embedded in the bottom of the mold recess, to firmly fix the mold-in fastening member 6 to the recess in position. Since the engaging elements are encased in the elastomer layer completely, the liquid molding resin injected into the mold cannot enter between the engaging elements and the engaging elements cannot be covered with the molding resin. After injecting the liquid molding resin into the mold, the resin is allowed to harden and the molded article is released from the mold. Then, the elastomer layer covering the engaging elements 2 is removed to expose the engaging elements 2 which are substantially free of the resin.

The molded article of foamed resin having the fastening member of the invention is used in the production of automotive seat, airplane seat, particularly seat for high-class motorcar. Various kinds of synthetic resins are usable as the molding resin, with polyurethane being preferably used because the molded article is generally a foamed cushion.

EXAMPLES

The present invention will be described with reference to the examples. However, it should be noted that the scope of the present invention is not limited to the following examples.

Example 1

Figure 3:
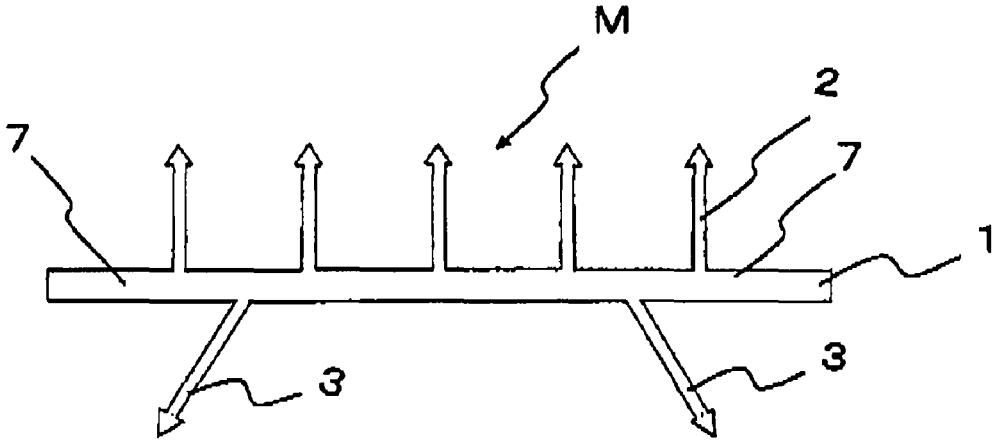
FIG. 3 is a schematic cross-sectional view of the main structure of the mold-in fastening member used in the example.

A polypropylene resin composition was prepared by adding 10% by weight of an olefin-based elastomer (V0131 manufactured by Sumitomo Chemical Company, Limited) to a polypropylene resin containing 0.5% by weight of titanium oxide. The polypropylene resin composition was extruded from an extrusion nozzle having a slit into a strip of shaped article which has a cross section as shown in FIG. 3, in which the engaging elements 2 was formed on the upper surface of the substrate 1 and the anchoring elements 3 was formed on the back surface of the substrate. The continuous ridge of engaging elements 2 was slit up to its foot at intervals of 0.3 mm and then the strip of shaped article was stretched by 3 times in the lengthwise direction, to produce a main structure M of the mold-in fastening member.

The obtained main structure M of the mold-in fastening member had the substrate of 12 mm wide and 0.5 mm thick. The substrate had on its upper surface the arrowhead hook engaging elements 2 having a height of 2 mm, a widthwise thickness (stem thickness) of 0.3 mm, and a lengthwise width of 0.3 mm. The engaging elements were formed in five columns and in a density of 45 per 1 cm of the fastening member. The substrate had on its back surface two ridges of anchoring elements continued in the lengthwise direction of the fastening member. The anchoring elements projected from the substrate at an angle of 60° and had a height of 2.5 mm and a width of 0.2 mm. The main structure of the fastening member was white due to titanium oxide included therein.

The upper surface having the engaging elements of the main structure M was applied with the melt of a resin composition (temperature of melt: 220° C.) in a thickness of 5 mm so as to completely encase the engaging elements. The resin composition was prepared by adding 60% by weight of a ferrite powder to a styrene-based elastomer resin (Septon CE002 manufactured by Kuraray Co., Ltd.) which was constituted by styrene block-isoprene block-styrene block wherein the isoprene block was hydrogenated. The applied resin composition was pressed down by a roller while it was still flowable so as to allow the elastomer resin to enter between the engaging elements. Neither of the widthwise end portions 7 of 1.5 mm wide having no engaging elements was covered with the elastomer layer. The elastomer layer was nearly black due to the ferrite powder included therein.

The wedge-shaped notches were formed on one widthwise end side of the fastening member covered with the elastomer resin at intervals of 10 mm in the lengthwise direction of the fastening member. The notches extended from the widthwise central portion to the widthwise end portion and its depth was 60% (7.2 mm) of the width of the substrate 1. As shown in FIG. 1, the wedge-shaped notch broadened towards its end portion and the largest width thereof was 3.0 mm. Then, the like wedge-shaped notches were formed on the other widthwise end side alternately with the notches already formed. The notches were formed on the substrate through the elastomer layer thereon and the anchoring elements thereunder. The obtained fastening member had a structure similar to that shown in FIG. 1 except for the main structure.

The obtained fastening member was cut into 30 cm long and fitted to a recess formed in each mold half 8 of two-part mold as shown in FIG. 2 with the elastomer layer 4 being brought into contact with the bottom of the recess. The mold used was for the production of automotive seat and the recess was formed in the position corresponding to both sides of the backrest of the automotive seat. The surface of the recess curved up and down (in the depth direction of the mold) with a radius of curvature of 25 cm and had a depth of 4 mm, a length of 300 mm and a width of 9 mm. The magnet 10 was embedded in the bottom of the recess 9 continuously in the lengthwise direction of the recess. After bending the fastening member 6 up and down and also right and left along the curved surface of the mold recess 9, the fastening member was fitted to the recess properly and fixed to the recess firmly without producing any defects. Then, a liquid urethane resin was injected into the mold to conduct the mold-in process. The formed molded article (cushion) was released from the mold. The surface of the elastomer was substantially free of the foamed urethane and the elastomer layer 4 was easily peeled off from the engaging elements 2 from its one end. In addition, it was easily confirmed whether the elastomer layer remained without being removed, because the colors of the elastomer layer and the fastening member were quite different from each other. The widthwise end portions 7 were completely encased in the foamed polyurethane. With such end portions and the anchoring elements 3, the fastening member 6 was not peeled off at all from the cushion even when the elastomer layer was peeled off from the engaging elements by a relatively large force.

The loop fibers on the back surface of a seat cover were engaged with the hook engaging elements of the obtained cushion to fix the seat cover on the cushion firmly. The cushion covered with the seat cover had a three-dimensionally complicated shape in conformity with human body, and the seat cover was fixed in well conformity with the three-dimensional shape. Thus, a seat with extremely high quality and comfortable sitting feeling was obtained.

Comparative Example 1

The same procedure as in Example 1 was repeated except for not forming the notches and the elastomer layer on the engaging elements and changing the width of the recess 9 to 12 mm. It was difficult to bend the obtained fastening member laterally in plane, and the fastening member was not fixed to the mold recess properly.

Comparative Example 2

The same procedure as in Example 1 was repeated except for not forming the notches. Although the result was improved as compared with Comparative Example 1, the fastening element was difficult to properly fix to the mold recess. Particularly, in the laterally curved portion, the outer side of the fastening member rose and lay outside the mold recess. Therefore, the portion of the fastening member outside the mold recess was completely embedded in the foamed resin and the elastomer layer was covered with the foamable liquid resin which entered through that portion. Therefore, the elastomer layer was not peeled off and the engaging function was lost at that portion.

Comparative Example 3

The same procedure as in Example 1 was repeated except for not forming the elastomer layer on the engaging elements and changing the width of the mold recess to 12 mm. Since the fastening member was not fixed to the recess properly, the fastening member was forced to bend and fitted to the recess. The lengthwise end portions had the engaging function. However, like Comparative Example 2, the outer side at the portion laterally bent in plane rose from the mold recess and was completely embedded in the foamed resin, thereby losing the engaging function.

Example 2

A cushion having the fastening member was produced in the same manner as in Example 1 except for changing the wedge-shaped notches to the simple slits. The simple slits were formed by simply cutting with a cutting blade having a width of 0.2 mm without removing a portion of the substrate, elastomer layer and anchoring elements in wedge form. The obtained fastening member was slightly poor in the lateral bending. As compared with any of comparative examples, however, the fastening member bent in good conformity with the three-dimensional shape and fitted to the mold recess properly. In the cushion produced by filling the mold with the foamable liquid resin, the elastomer layer was substantially free of the foamed urethane and the elastomer layer was easily peeled off from the engaging elements from its one end. The widthwise end portions were completely embedded in the foamed polyurethane. With such end portions and the anchoring elements, the fastening member was not peeled off at all from the cushion even when the elastomer layer was peeled off by a relatively larger force.

INDUSTRIAL APPLICABILITY

The mold-in fastening member of the invention can be fixed in position of the molded article of foamed resin which has a complicated curved surface as in the seat for high-class motor cars. The mold-in fastening member is used in the production of automotive seats and airplane seats, particularly seats for high-class motor cars.

What is claimed is:

1. A mold-in fastening member which comprises a strip of substrate, engaging elements formed on one surface of the substrate, and an elastomer layer completely surrounding the engaging elements of the fastening member, the substrate having slits or notches which extend from a widthwise central portion of the substrate to a widthwise end portion of the substrate, wherein the fastening member having independent engaging elements on its surface is produced by melt-extruding a thermoplastic resin into a tape form from a nozzle having a predetermined slit having a shape corresponding to the lengthwise cross section of each of the substrate and the engaging elements, thereby forming a tape having ridges of the engaging elements which are continuous in the lengthwise direction of the tape on the surface of the substrate; slitting down the continuously projecting ridges of the engaging elements formed on the surface at small intervals; and then stretching the tape in the lengthwise direction, wherein the thermoplastic resin comprises a mixture of at least one non-elastomer resin and at least one elastomer resin and the elastomer resin is added in an amount of 2 to 30% by weight of the non-elastomer resin.

2. The mold-in fastening member according to claim 1, wherein a depth of the slits or notches is ¼ to ¾ of a width of the fastening member.

3. The mold-in fastening member according to claim 1, wherein the slits or notches are formed at intervals of 5 to 30 mm in a lengthwise direction of the fastening member.

4. The mold-in fastening member according to claim 1, wherein the elastomer layer comprises a magnetically attractable powder.

5. The mold-in fastening member according to claim 1, wherein widthwise end portions on the surface having the engaging elements are not covered with the elastomer layer.

6. The mold-in fastening member according to claim 1, wherein an anchoring member or anchoring elements are formed on a surface opposite to the surface having the engaging elements.

7. The mold-in fastening member according to claim 1, wherein the elastomer layer and the substrate have different colors.

8. The mold-in fastening member according to claim 1, wherein the elastomer layer does not have the slits or notches.

9. A method of producing a molded article of foamed resin having a fastening member using a mold-in fastening member which comprises a substrate, engaging elements, and an elastomer layer completely surrounding the engaging elements of the fastening member, wherein the fastening member having independent engaging elements on its surface is produced by melt-extruding a thermoplastic resin into a tape form from a nozzle having a predetermined slit having a shape corresponding to the lengthwise cross section of each of the substrate and the engaging elements, thereby forming a tape having ridges of the engaging elements which are continuous in the lengthwise direction of the tape on the surface of the substrate; slitting down the continuously projecting ridges of the engaging elements formed on the surface at small intervals; and then stretching the tape in the lengthwise direction, wherein the thermoplastic resin comprises a mixture of at least one non-elastomer resin and at least one elastomer resin and the elastomer resin is added in an amount of 2 to 30% by weight of the non-elastomer resin, the substrate having slits or notches which extend from a widthwise central portion of the substrate to a widthwise end portion of the substrate, the method comprising:

fitting the mold-in fastening member into a recess formed in a mold while allowing the elastomer layer to face a bottom of the mold;

injecting a foamable liquid resin into the mold;

hardening the foamable resin to obtain a molded article having the fastening member;

releasing the molded article having the fastening member from the mold; and removing the elastomer layer.

* * * * *